US009326604B1

(12) United States Patent
Schuldt et al.

(10) Patent No.: US 9,326,604 B1
(45) Date of Patent: May 3, 2016

(54) INVENTORY SYSTEM FOR WIRE SHELVES

(71) Applicant: LogiQuip LLC, Galesburg, MI (US)

(72) Inventors: Eric Schuldt, Galesburg, MI (US); Jeffrey W. Mote, South Lyon, MI (US)

(73) Assignee: LogiQuip, LLC, Galesburg, MI (US)

( * ) Notice: Subject to any disclaimer, the term of this patent is extended or adjusted under 35 U.S.C. 154(b) by 0 days.

(21) Appl. No.: 14/731,773

(22) Filed: Jun. 5, 2015

Related U.S. Application Data

(60) Provisional application No. 62/008,115, filed on Jun. 5, 2014.

(51) Int. Cl.

| | |
|---|---|
| ***A47F 5/00*** | (2006.01) |
| ***A47B 96/04*** | (2006.01) |
| ***A47B 96/02*** | (2006.01) |
| ***G09F 3/00*** | (2006.01) |

(52) U.S. Cl.
CPC ..... *A47B 96/04* (2013.01); *A47B 96/021* (2013.01); *G09F 3/00* (2013.01); *A47F 5/005* (2013.01)

(58) Field of Classification Search
CPC ..... A47B 96/04; A47B 96/021; A47F 5/005; Y10T 24/344; Y10T 16/525; G09F 3/00
USPC ..... 211/181.1, 184; 220/486–489, 529, 220/530, 531; 108/60, 61, 97, 98
See application file for complete search history.

(56) References Cited

U.S. PATENT DOCUMENTS

| | | | | | |
|---|---|---|---|---|---|
| 591,377 | A * | 10/1897 | Bunce | A47L 19/04 | 211/41.3 |
| 1,157,045 | A * | 10/1915 | Risher | B42F 17/02 | 206/561 |
| 1,660,410 | A * | 2/1928 | Beckman | B65D 7/065 | 206/511 |
| 1,758,307 | A * | 5/1930 | Bales | A47B 57/58 | 108/61 |
| 1,759,993 | A * | 5/1930 | McGill | A47L 19/00 | 220/487 |
| 1,806,642 | A * | 5/1931 | Ohnstrand | A47B 65/00 | 108/61 |
| 2,415,054 | A * | 1/1947 | Weil | B42F 17/02 | 206/425 |
| 2,538,908 | A * | 1/1951 | McKeehan | A47F 5/005 | 211/11 |
| 2,586,005 | A * | 2/1952 | Colonna | A47L 15/0065 | 220/487 |
| 2,811,277 | A * | 10/1957 | Gaines | B65D 19/10 | 220/486 |
| 2,868,391 | A * | 1/1959 | Sides | A47F 5/13 | 211/126.1 |
| 2,885,085 | A * | 5/1959 | Chamberlin | A47B 57/58 | 211/10 |
| 2,971,668 | A * | 2/1961 | Peglow | A47L 15/503 | 211/41.8 |
| 3,022,593 | A * | 2/1962 | Sides | G09F 3/20 | 40/308 |
| 3,117,533 | A * | 1/1964 | Martland | A47B 41/00 | 108/60 |
| 3,117,535 | A * | 1/1964 | Hendrickson | A47B 41/00 | 108/185 |

(Continued)

*Primary Examiner* — Joshua J Michener
*Assistant Examiner* — Devin Barnett
(74) *Attorney, Agent, or Firm* — Miller Canfield Paddock and Stone; Mark L Maki

(57) ABSTRACT

An inventory system for wire shelving is provided which includes a pivoting divider unit that subdivides individual bins of a shelving system into front and rear sections accessed through an open front side of the bin. The divider unit hinges between an upright position and a forwardly-lowered position. When fully stocked, the bin includes articles which are located in both the forward and rearward bin sections with the divider unit oriented in the upright position between adjacent articles. As articles are removed from the front bin section, eventually the divider unit is exposed. The divider unit is then manually tilted forwardly or lowered to allow continued removal of articles from the rear bin section. This lowered orientation of the divider unit indicates that the front bin section is now empty and restocking is due. The divider unit rotatably engages with the wire shelving and includes hinge clips which releasably lock the divider unit in the upright orientation.

20 Claims, 7 Drawing Sheets

(56) References Cited

U.S. PATENT DOCUMENTS 3,145,850 A * 8/1964 Ciborowski ..... A47F 5/01 108/27
3,269,556 A * 8/1966 Streater ..... A47F 5/01 108/147.17
3,282,460 A * 11/1966 Boznango ..... A47J 37/1295 206/513
3,625,371 A * 12/1971 Dill ..... A47B 96/025 108/90
3,730,354 A * 5/1973 Bronstein ..... A47G 25/005 211/181.1
3,739,918 A * 6/1973 Kreitzburg ..... A47F 7/18 211/181.1
3,750,894 A * 8/1973 Jensen ..... A47F 5/005 211/184
3,800,958 A * 4/1974 Dorn ..... A47F 7/148 211/181.1
3,827,574 A * 8/1974 Craig, Sr. ..... A47F 5/005 211/184
3,869,060 A * 3/1975 Goyheneix ..... B65D 7/20 217/19
3,877,580 A * 4/1975 Hammar ..... A47B 57/581 108/27
4,023,682 A * 5/1977 Niece ..... A47B 57/581 108/27
4,190,167 A * 2/1980 Wells ..... A47F 5/005 108/61
4,437,572 A 3/1984 Hoffman
4,458,585 A * 7/1984 Erbach ..... A47J 37/0786 211/181.1
4,512,480 A * 4/1985 Evenson ..... B42F 17/12 108/60
4,675,970 A * 6/1987 Galen ..... A47B 57/58 108/61
5,082,139 A * 1/1992 Quam ..... B65F 1/0046 220/530
5,341,945 A * 8/1994 Gibson ..... A47F 5/005 108/60
5,351,837 A * 10/1994 Smith ..... A47L 15/503 211/41.8
5,356,004 A * 10/1994 Weinreb ..... A45C 13/02 150/113
5,411,146 A * 5/1995 Jarecki ..... A47F 5/0056 211/184
5,437,380 A * 8/1995 Peay ..... A47F 5/0056 108/61
5,442,872 A 8/1995 Moser
5,449,076 A * 9/1995 Van Noord ..... A47F 5/01 211/106
5,601,195 A * 2/1997 Finola ..... A47L 15/503 211/41.8
5,934,633 A 8/1999 Padiak et al.
6,023,024 A * 2/2000 Stjerneby ..... H02G 3/0443 174/95
6,390,310 B1 5/2002 Insalaco
6,460,710 B1 * 10/2002 Dardashti ..... A47B 57/26 108/61
6,595,120 B1 * 7/2003 Tiemann ..... A47J 37/0694 211/181.1
6,913,386 B2 * 7/2005 Maher ..... B65D 31/12 190/110
6,945,421 B2 * 9/2005 Phifer ..... A47L 15/502 220/486
7,198,340 B1 4/2007 Ertz
D544,260 S * 6/2007 Nawrocki ..... D8/373
7,703,866 B2 * 4/2010 Benz ..... F25D 25/02 211/184
7,950,537 B1 * 5/2011 Goodman ..... A47B 57/581 211/184
8,104,628 B2 * 1/2012 Kim ..... A47L 15/503 211/171
8,210,622 B2 * 7/2012 Forrest ..... A47B 96/04 211/184
8,387,817 B1 * 3/2013 Zelechonok ..... B65D 77/065 137/259
8,418,604 B1 * 4/2013 Zemel ..... A47J 37/0694 211/181.1
8,522,571 B2 * 9/2013 Smith ..... F25C 5/005 220/495.01
8,579,121 B2 * 11/2013 Eng ..... A47L 15/505 211/184
8,800,802 B2 * 8/2014 Martin ..... B65D 85/78 220/529
2003/0029824 A1 * 2/2003 Weiler ..... A47B 57/583 211/184
2003/0189018 A1 * 10/2003 Hopkins ..... A47F 5/01 211/90.02
2004/0099619 A1 * 5/2004 Bustos ..... A47F 5/01 211/59.2
2005/0039640 A1 * 2/2005 Ogden ..... A47B 57/588 108/61
2007/0108149 A1 * 5/2007 Lee ..... A47B 88/20 211/189
2008/0029517 A1 * 2/2008 Briers ..... B65D 25/06 220/495.01
2010/0219147 A1 * 9/2010 Moody ..... F25D 25/025 211/181.1
2010/0252519 A1 * 10/2010 Hanners ..... A47F 5/005 211/184
2010/0307998 A1 * 12/2010 Chen ..... A47F 5/0043 211/184
2011/0290796 A1 * 12/2011 Burgess ..... B65D 21/04 220/23.2
2011/0290804 A1 * 12/2011 Kohles ..... A47L 15/503 220/488
2014/0124511 A1 * 5/2014 Ruijssenaars ..... B65D 25/06 220/529
2014/0263353 A1 * 9/2014 Bell ..... B65D 25/06 220/531
2015/0076086 A1 * 3/2015 Tsai ..... B42F 7/10 211/11

* cited by examiner

INVENTORY SYSTEM FOR WIRE SHELVES

CROSS REFERENCE TO RELATED APPLICATIONS

This application asserts priority from provisional application 62/008,115, filed on Jun. 5, 2014, which is incorporated herein by reference.

FIELD OF THE INVENTION

The invention relates to an inventory system for wire shelves and more particularly, to a pivotable divider unit and a hinge clip therefor.

BACKGROUND OF THE INVENTION

Wire shelving and inventory systems are used in a variety of environments and often are used in healthcare environments. These shelving systems typically include multiple shelves arranged in columns and rows of open-sided bins or compartments in which various articles are stored. These articles can be medical supplies of various types wherein each bin would hold an inventory of a preferred number of such articles.

In the medical environment, for example, these shelving systems are provided for inventory storage and management wherein various medical personnel and other individuals might remove selected articles from the bins, depending upon their individual needs.

In a medical environment it is critical, however, that the articles, which typically are medical supplies, are efficiently replenished when necessary. In an open-sided bin with a fixed volume, the bin would be filled with articles, and then such articles removed as needed. With such a bin arrangement, inadequate inventory management practices can create problems.

For example, hoarding and stock outs might occur if supply does not adequately track demand for articles. This can lead to emergency restocking or excessively frequent restocking and replenishment when the bins are only partially empty. If the bins are not tracked properly, stock obsolescence may also occur. Ultimately, inefficient stocking practices can lead to excessive direct and hidden supply chain costs.

It is an object of the invention to provide an improved inventory system for new wire shelving systems as well as retrofit applications.

The invention relates to an inventory system for wire shelving which subdivides the individual bins or compartments of a shelving system into first and second bin or compartment sections typically oriented as front and rear bin sections accessed through an open front side of the bin. The inventory system generally comprises a pivoting divider unit which mounts at an intermediate location between the front and rear of a main bin section, so as to sub-divide the main bin section into front and rear bin sections. The term bin refers to any of various compartments defined in or used with a shelving system, wherein the shelving system may be of various forms such as freestanding or wall-mounted.

The divider unit hinges between an upright position and a forwardly-lowered position wherein the divider unit pivots forwardly and lies on the front edge of the bin opening. Generally, an open-sided bin or compartment defines a storage space or product lane that allows for storage of various articles, generally arranged in a front-to-back direction. When fully stocked, the bin or compartment includes articles which are located in both the forward and rearward bin sections with the divider unit oriented in the upright position so as to minimize the amount of space used by the divider unit. Essentially, the divider unit is not readily noticeable in this orientation. As articles are removed from the bin section or compartment section, eventually the divider panel is exposed through the open front of the bin. To allow continued removal of articles from the rear bin section, the divider unit is then manually tilted forwardly or lowered so that it rests on the front edge of the bin opening. This lowered orientation of the divider unit indicates that the front bin section is now empty and restocking is due to prevent running out of stock or articles in the rear bin section. Essentially therefore, the divider unit indicates that the bin is close to the point where restocking might be required, or may indicate that restocking may soon be required.

Preferably, the divider unit includes a plate-like panel unit or main body which includes a display panel on the free edge portion. The display panel faces forwardly or is exposed when the divider unit is in the lowered position. The display panel has one or more indicators which indicate the type of article being stored in this respective bin and when exposed, provides an indication or cue that restocking should soon occur. In the lowered position and the indicator exposed for viewing, an individual taking inventory will be triggered to start the process for replenishing the partially-empty bin. In the preferred embodiment the indicator may include a bar code which is detectably by a bar code reader or other similar device being operated by the individual. This individual may use the bar code reader to detect the type of article and generate a replenishment order through a computer system or the like.

During restocking, the articles would first be replaced so as to refill the rear bin section, and then the divider unit is lifted to the upright position. Then the front bin section would be refilled so as to complete the replenishment of the individual bin to ensure a continuous supply of articles.

This divider unit includes an inventive hinge clip which is removably engaged with the display panel. The divider unit rotatably engages with the wire shelving and includes one or more hinge clips which may releasably lock the divider unit in the upright orientation.

More particularly, each hinge clip has an engagement portion which engages to an existing piece of wire frame forming the wire shelving so as to hingedly mount the divider unit to the wire shelving. The hinge clip defines a hinge or pivot axis about which the display panel rotates between the upright and lowered positions. Preferably, the hinge clip is oriented so that the pivot axis is horizontal and the divider unit rotates between the upright and lowered positions.

The hinge clip also includes a cantilevered locking member, which is resiliently deflectable and includes a locking portion or locking formation that engages an adjacent section of the shelving wire. This positively maintains the divider unit in the upright position while allowing for free disengagement simply by an individual manually grasping the divider unit and pulling same forwardly to the lowered position. As such, the hinge clip provides for automatic positive locking and automatic release, simply by manipulating the divider unit. Preferably, the hinge clip rotatably engages to the wire frame to permit original and retrofit engagement of the hinge clip to the wire frame structures by an installer. This provides an improved inventory system for use in various environments including healthcare environments.

Other objects and purposes of the invention, and variations thereof, will be apparent upon reading the following specification and inspecting the accompanying drawings.

Figure 1:
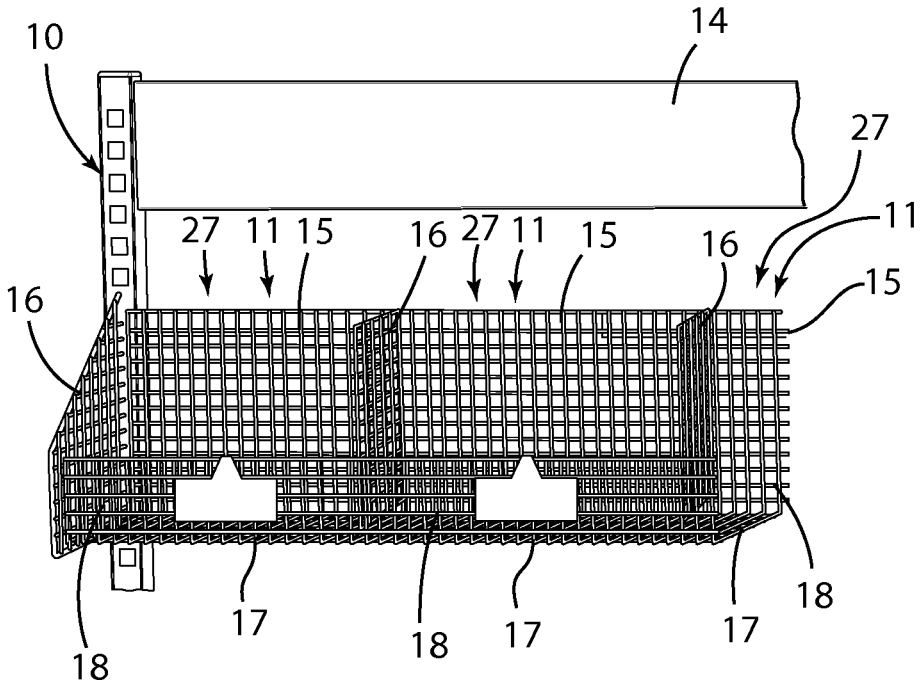
FIG. 1 is a perspective view of a shelving system.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
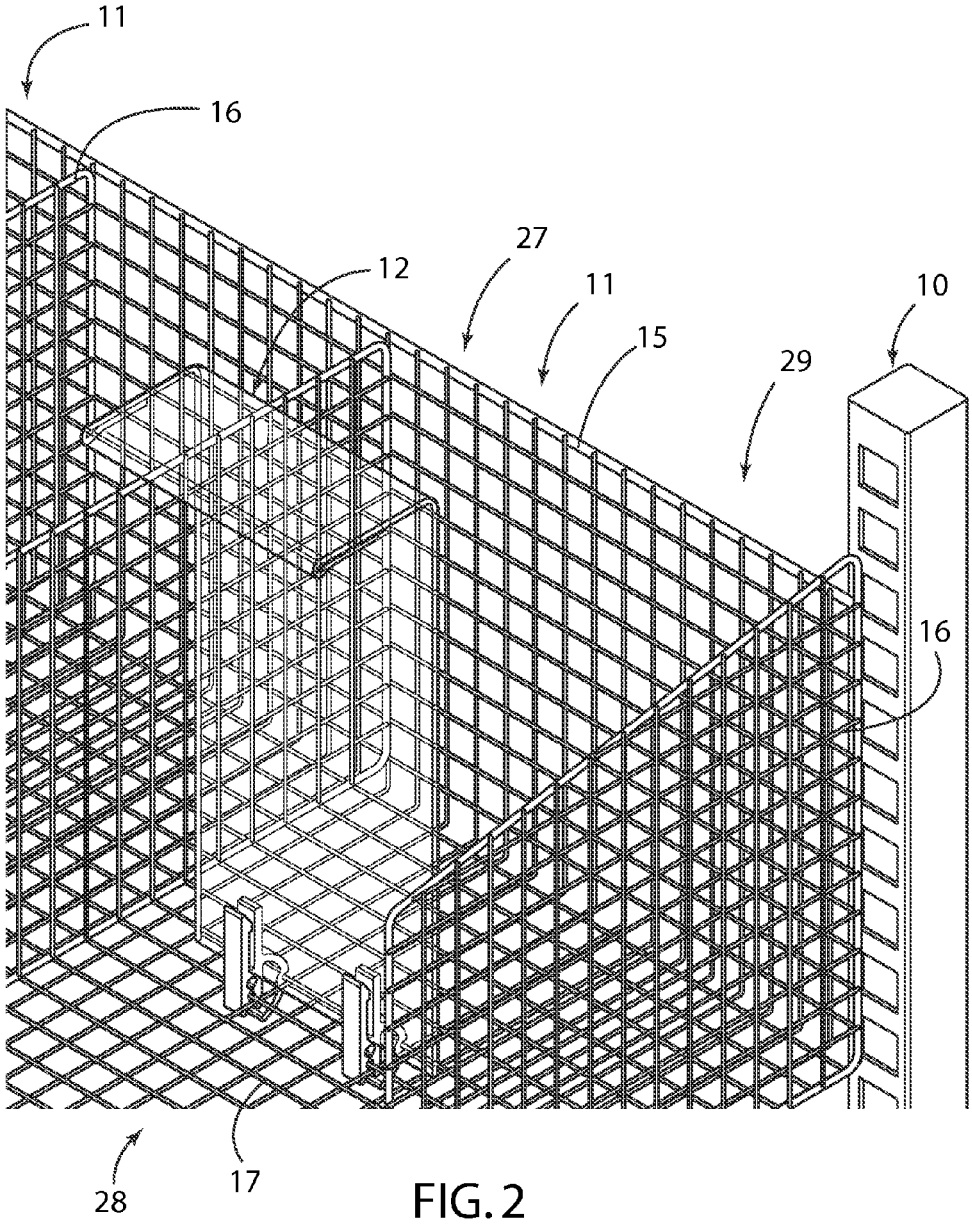
FIG. 2 is a perspective view of the shelving system with a divider unit of the invention in a first position
Figure 3:
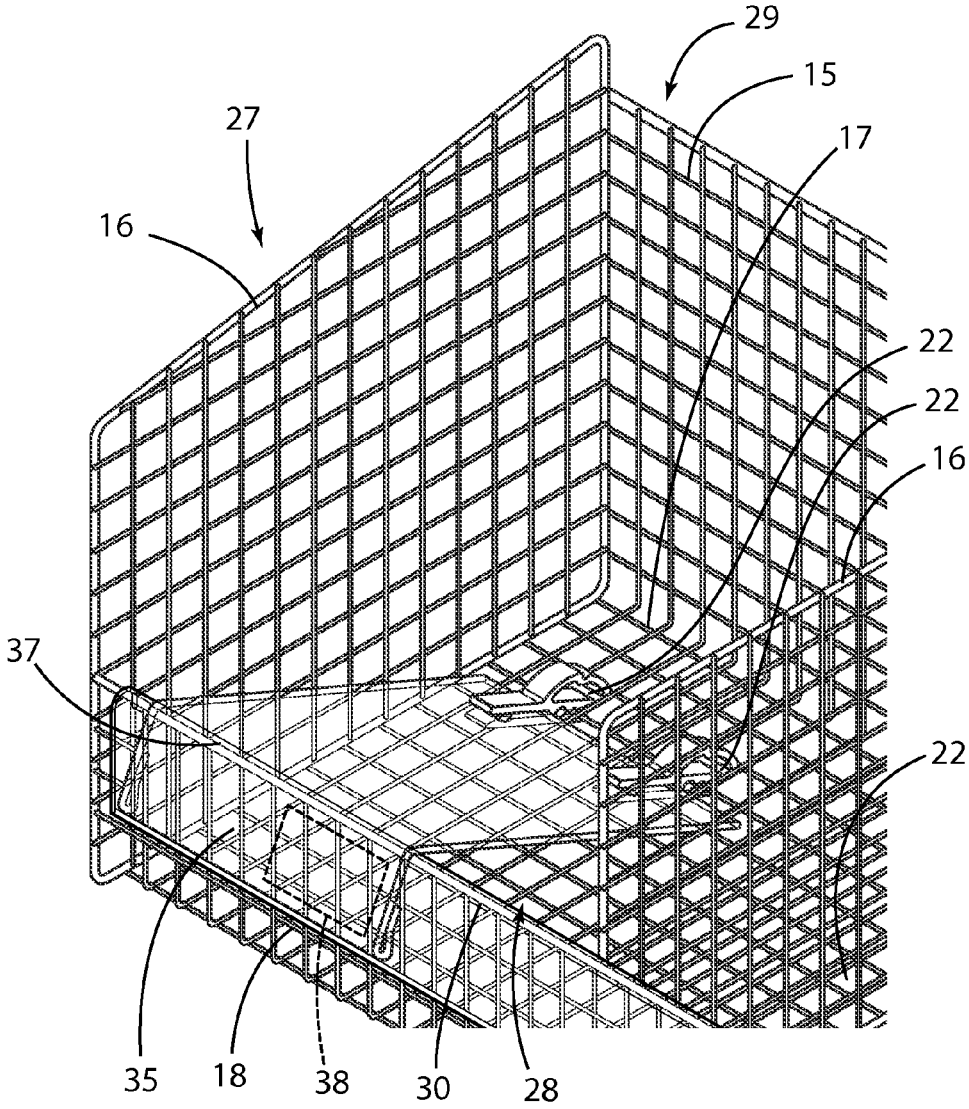
FIG. 3 is a perspective view of the shelving system with the divider unit in a second position.

Referring to FIGS. 1 and 2, the invention relates to an inventory system for a wire shelving system 10 which subdivides individual bins or compartments 11 of the shelving system 10 through the use of a pivotable divider unit 12 (FIG. 2). The divider unit 12 nests or is sandwiched in an upright first position between articles stored within a particular bin 11, or when exposed by removal of articles from the bin 11, the divider unit 12 is pivoted to a lowered second position to provide an indication that the bin or compartment 11 is in need of restocking within an appropriate time period. FIG. 2 illustrates the divider unit 12 oriented in the first position and FIG. 3 illustrates the divider unit 12 oriented in the second position.

Generally, as to the shelving system 10, the inventive divider unit 12 preferably is usable with wire-type shelving units wherein the various shelf walls are formed of a rigid wire mesh material. The wire mesh is defined by transverse sections of wire joined together in a desired pattern. These shelving systems 10 are conventional. It will be understood that the inventive divider unit 12 might also be adapted for use on other types of shelving systems, and the present invention therefore is not limited to the specific wire shelving system disclosed herein.

The shelving system 10 is shown in FIG. 1 with a rigid frame 14 that might be freestanding or wall-mounted. The frame 14 supports rows and columns of bins or compartments 11. FIG. 11 shows each of the bins 11 being defined by bin walls which preferably comprise back walls 15, side walls 16, bottom walls 17 and if desired, a partial front wall 18, which in turn forms a front bin opening 19. In the illustrated system, each bin 11 is also open at the top although the bins or compartments in many shelving systems might be closed on the top by top walls. Further, the shelf may have compartments with separate bins or baskets disposed therein, or the bins or compartments may be separate storage structures or baskets individually mounted to a separate frame. Here again, the present invention is not limited to the specific wire shelving system disclosed herein.

Figure 7:
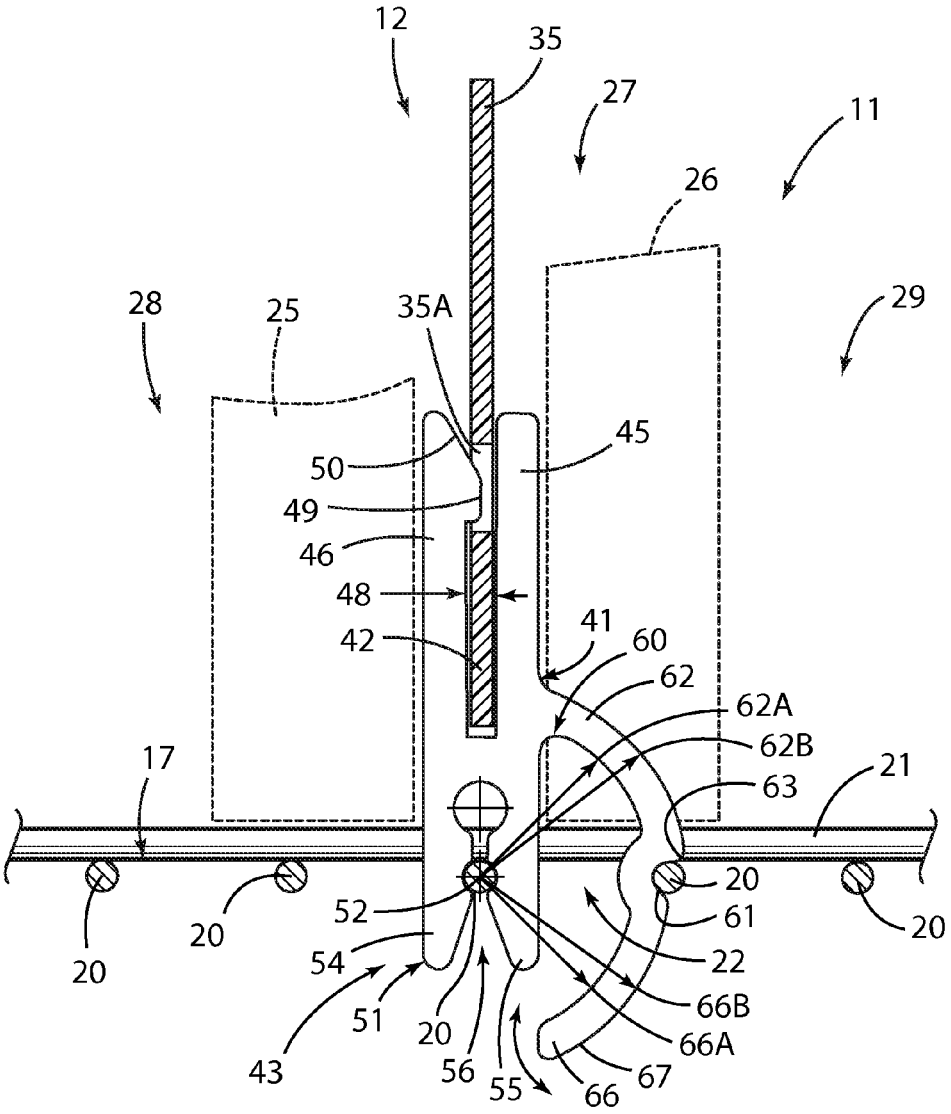
FIG. 7 is a side view of the hinge clip mounted to the divider panel.

Most preferably, the divider unit 12 mounts to a bottom wall 17 of a respective one of the bins 11, wherein each bin 11 preferably includes a respective divider unit 12. FIG. 7 shows one such divider unit 12 mounted to the bottom wall 17 of a bin 11. The bottom wall 17 generally is formed of a wire mesh comprising a plurality of parallel lateral wire sections 20, which run parallel to a front edge of the bins 11 and which are rigidly joined together with parallel main wire sections 21 that run in the front to back direction of the bin 11. As such, the wire mesh defines rectangular open spaces 22 bounded by an adjacent pair of main wire sections 21 and lateral wire sections 20. As described below, the divider unit 12 is structured to pivotally engage with the wire mesh and preferably, with a selected lateral wire section 20 provided on the bottom wall 17.

As previously described, this type of wire shelving system 10 is configured for storage of various articles within the bins or compartments 11. These articles can be virtually any type of article which fits within the storage space formed in the bin 11 and is usable with the divider unit 12. In effect, the bin or compartment 11 can define a storage space or product lane in which the articles can be arranged one next to the other in the front to back direction. As such, the articles may be removed starting from the front and working rearwardly. In a healthcare environment, the stored articles may be medical supplies of various types, sizes and shapes wherein each bin 11 would hold an inventory of a preferred number of such articles. Preferably, the articles store in a manner that allows for stocking in the front to back direction and removal through the open front of the bin 11. In the medical environment, for example, these shelving systems are provided for inventory storage and management wherein various medical personnel and other individual consumers might remove selected articles from the bins, depending upon their individual needs.

To facilitate the organization, removal and replenishment or restocking of the articles, each of the bins 11 preferably is subdivided by a divider unit 12 as shown in FIGS. 2, 3 and 7. Generally referring to FIGS. 2 and 7, the bin 11 includes the divider unit 12 which preferably is oriented in the upright first position so that articles 25 and 26 (FIG. 7) can be stored in both the front and rear of the divider unit 12. As articles 25 are removed from the front side of the divider unit 12, the divider unit 12 can be manually pivoted forwardly to the lowered second position shown in FIG. 3.

More particularly, the inventory system of the present invention generally comprises a plurality of the pivoting divider units 12 wherein one divider unit 12 is mounted in each respective one of the bins 11 provided in the shelving system 10. By managing replenishment in each of the bins 11, a uniform inventory management system is provided for monitoring the stock of articles 25 and 26.

Each divider unit 12 mounts at an intermediate location between the front and rear of a main bin section 27, so as to sub-divide the main bin section 27 into first and second bin sections 28 and 29. The first and second bin sections 28 and 29 are typically oriented as front and rear bin sections accessed through the open front side or front bin opening 19 of the bin 11. It will be understood that the divider unit 12 can be mounted at various locations in the front to back direction depending upon the size of the articles and the point at which the divider unit 12 should cue an individual to start the restocking procedure.

As mentioned above, the divider unit 12 hinges between an upright first position (FIGS. 2 and 7) and a forwardly-lowered position (FIG. 3) wherein the divider unit 12 pivots forwardly and lies on the front edge 30 of the bin opening 19. In the illustrated shelf construction, the front edge 30 is defined at the top of the partial front wall 18. In some applications the front wall 18 might be omitted but the front edge 30 would be defined by other frame structure.

When the bin 11 is fully stocked, the bin 11 includes the articles 25 and 26 which are respectively located in both the forward and rearward bin sections 28 and 29 with the divider unit 12 oriented in the upright position so as to minimize the amount of space used by the divider unit 12. It will be understood that the articles 25 and 26 in one particular bin 11 are identical articles although this is not a requirement of the present invention.

As articles 25 are removed from the front bin section 28, the divider panel 12 is eventually exposed through the open front 19 of the bin 11. To allow continued removal of articles 26 from the rear bin section 29, the divider unit 12 is then manually tilted forwardly or lowered so that it rests on or adjacent to the front edge 30 of the bin opening 19 as seen in FIG. 3. In this regard, the divider unit 12 might rest directly on the edge 30, extend forwardly beyond and overlap the edge 30 and sit rearwardly adjacent to such edge 30. This lowered orientation of the divider unit 12 indicates that the front bin section 28 is now empty and restocking is due to prevent running out of articles 26 in the rear bin section 29. Essentially therefore, the divider unit 12 indicates that the bin 11 is close to the point where restocking might be required, or may indicate that restocking may soon be required.

Figure 4:
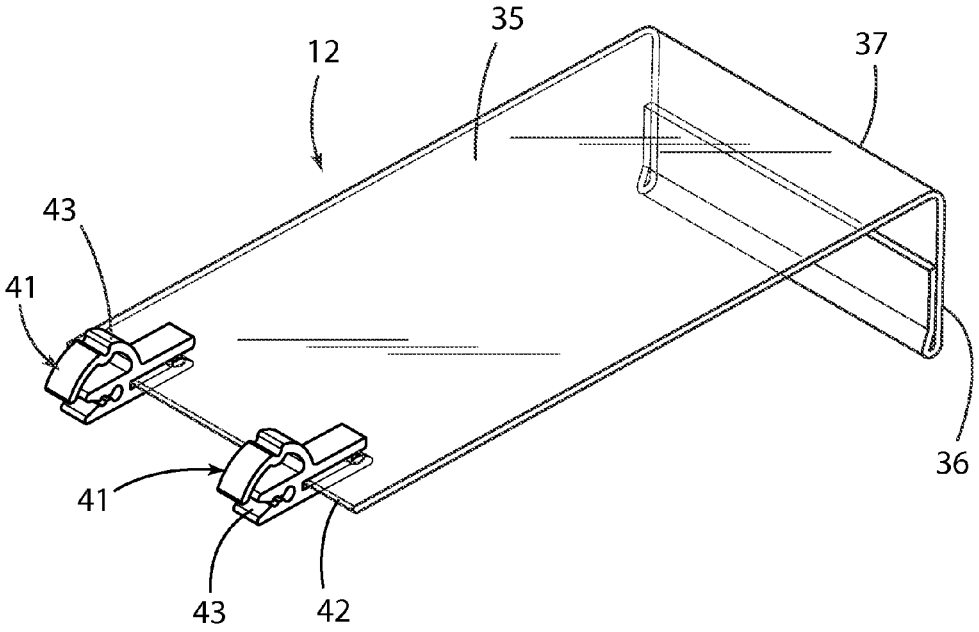
FIG. 4 is a perspective side view of the divider unit comprising a divider panel and hinge clips.

The divider unit 12 includes an inventive construction. Referring to FIG. 4, the divider unit 12 includes a plate-like panel unit 35 which includes a depending display panel 36 on the free edge portion 37. As best seen in FIG. 3, the display panel 36 on the free edge portion 37 has one or more indicators 38 which indicate the type of article or articles 25/26 being stored in this respective bin 11. The indicator 38 is shown in phantom outline to represent different variations of indicators. As one example, the indicator 38 may be a stick-on adhesive label which includes various written and/or symbolic indicia thereon. When the indicator 38 is exposed as seen in the lowered position of FIG. 3, the indicator 38 provides an indication or cue that restocking should soon occur. With the display panel 12 in the lowered position and the indicator 38 exposed for viewing, an individual taking inventory will be triggered to start the process for replenishing the partially-empty bin or compartment 11.

In the preferred embodiment, the indicator 38 may comprise a bar code which is detectably by a bar code reader or other similar device being operated by the individual. This individual may use the bar code reader to detect the type of article and generate a replenishment order through a computer system or the like. Other signaling type indicators 38 may also be included thereon such as RFID chips.

During restocking, the articles 26 would first be replaced so as to refill the rear bin section 29, and the display unit 12 would then be lifted to the upright hidden position of FIGS. 2 and 7. Then the front bin section 28 would be refilled with articles 25 so as to complete the replenishment of the individual bin 11 for continued supply of articles to medical staff and other consumers.

Figure 5:
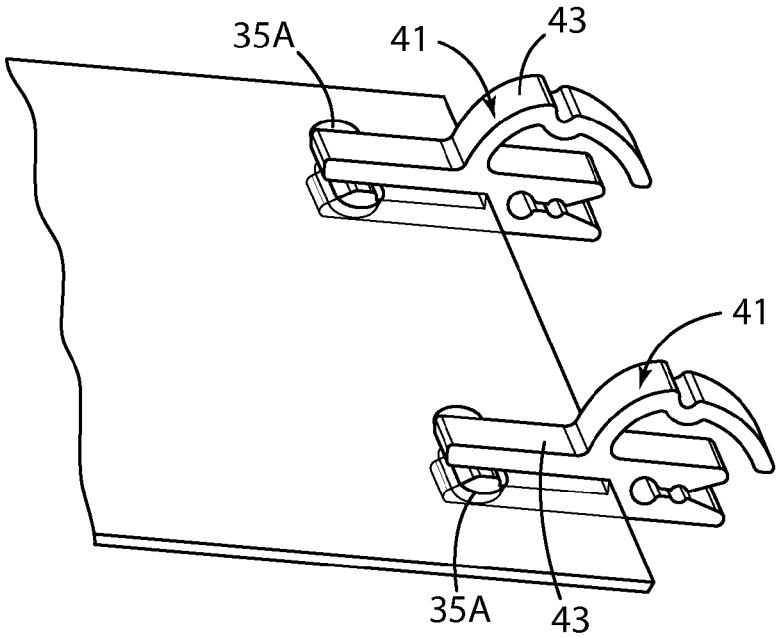
FIG. 5 is an enlarged perspective view of a first embodiment of the hinge clips mounted to the divider panel.

The display unit 12 comprises the panel unit 35 and one or more hinge units 41 (FIGS. 4 and 5) mounted to the bottom panel edge 42 thereof. The hinge units 41 preferably are formed as an improved hinge clip 43 which has a monolithic molded plastic construction. Each hinge clip 43 is removably engaged with the panel unit 35 preferably through a snap locking engagement. This provides for tool free mounting of the hinge clips 43 to the bottom panel edge 42. For purposes of mounting, the hinge clip 43 includes a pair of lock formations formed as slots 35A.

Figure 6:
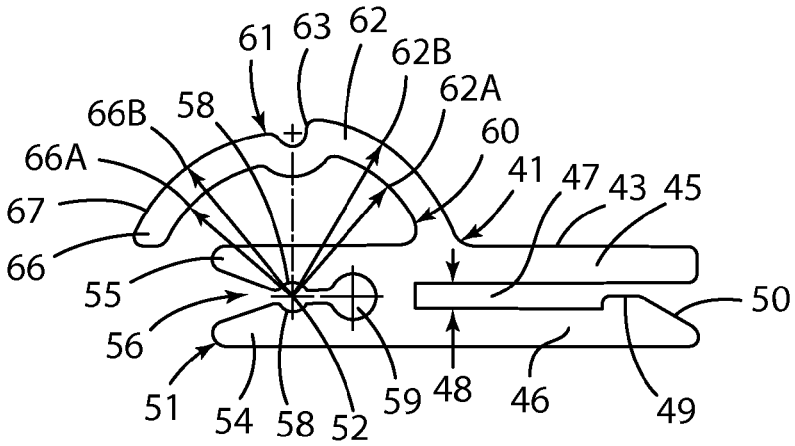
FIG. 6 is a side view of the hinge clip of the first embodiment.

Referring to the hinge clips 43 as seen in FIGS. 6 and 7, a first embodiment of the invention is shown wherein each hinge clip 43 has a mounting portion 44 which is comprised of a fixed jaw 45 and a deflectable jaw 46. The jaws 45 and 46 are spaced apart and define a mounting slot 47 therebetween. The slot 47 has a width 48 that is sized to tight-fittingly receive the bottom panel edge 42 therein. The deflectable jaw 46 includes a projection 49 adjacent a cam surface 50 which spreads the jaws 45 and 46 as the bottom panel edge 42 is slid into the slot 47. Once the projection 49 passes over the panel slot 35A, the projection 49 drops into the panel slot 35A and snap locks the hinge clip 43 to the panel unit 35.

The display unit 12 is now in the form of an assembly of the panel unit 35 and the hinge clips 43 as seen in FIG. 4. Next, each hinge clip 43 includes an engagement portion 51 at an end opposite to the mounting portion 44. The engagement portion 51 snap lockingly engages with a wire frame section forming the wire shelving and preferably connects to a lateral wire section (FIG. 7) so as to hingedly mount the display unit 12 to the wire shelving 10. The hinge clip 43 defines a hinge or pivot axis 52 about which the display unit 12 rotates between the first and second positions of FIGS. 2 and 3. While the pivot axis 52 is preferably oriented horizontally and parallel to the front shelf edge 30, it is possible to snap the hinge clips 43 to a side wall 16 to define a vertical pivot axis, although this orientation is not preferred.

The engagement portion 51 preferably comprises a pair of resiliently deflectable connector jaws 54 which define a slot 55 and have inclined camming surfaces 56 which spread the jaws 54 when the wire section 20 is slid into the slot 55 to the seated position shown in FIG. 7. In this seated position, the hinge clip 43 rotates about the wire section 20.

Referring to FIG. 6, the inside surfaces of the jaws 54 include arcuate seats 58 which receive and rotatably seat the outside of the wire section 20. A flexure channel 59 is formed at the inner end of the slot 55 to facilitate flexing of the jaws 54. With this structure, the hinge clips 43 and associated divider unit 12 are snap locked onto the wire section 20.

Referring to FIGS. 6 and 7, the hinge clip 43 also includes a cantilevered locking member 60, which is resiliently deflectable and includes a locking portion or locking formation 61 that engages a lateral wire section 20 adjacent to the above-described wire section 20 that is fitted in the slot 56. This locking member 60 positively maintains the divider unit 12 in the upright position of FIGS. 2 and 7 while allowing for free disengagement simply by an individual manually grasping the divider unit 12 and pulling same forwardly to the lowered position of FIG. 3.

Preferably, the locking member 60 is formed of a first section 62 which is dimensioned with a first inside radius 62A and outside radius 62B. The first section 62 terminates at the locking formation 61 which is formed as an arcuate seat and defines an abutment or stop 63. This stop 63 abuts against the wire section 20 and prevents further rearward rotation of the divider unit 12 past the first position.

The locking member 60 also includes a second section 66 that defines a terminal end and cam surface 67 that faces toward and abuts against the outer surface of the lateral wire section 20 to cause resilient deflection of the locking member 60. The second section 66 is dimensioned with a second inside radius 66A and outside radius 66B smaller than the first inside radius 62A and outside radius 62B. This radial difference allows sliding contact of the cam surface 67 with the wire section 20 to deflect the locking member 60 as it rotates into the mesh space 22 formed between two adjacent wire sections 20. The larger dimension of the first section 62 forms the stop 63 which defines the limit for rotation of the divider unit 12.

The recessed shape of the locking formation 61 seats the wire section 20 therein during panel rotation. As such, the hinge clip 43 provides for automatic positive locking of the divider unit 12 in the upright position, and allows for automatic release, simply by pulling the divider panel 12 forwardly. As another advantage, the hinge clip 43 allows for easy snap locking engagement with the wire mesh to permit mounting to a new or original shelving system 10, and also allows for retrofit engagement of the divider unit 12 to any suitable wire frame structures by an installer. This provides an improved inventory system for use in various environments including healthcare environments.

Figure 8:
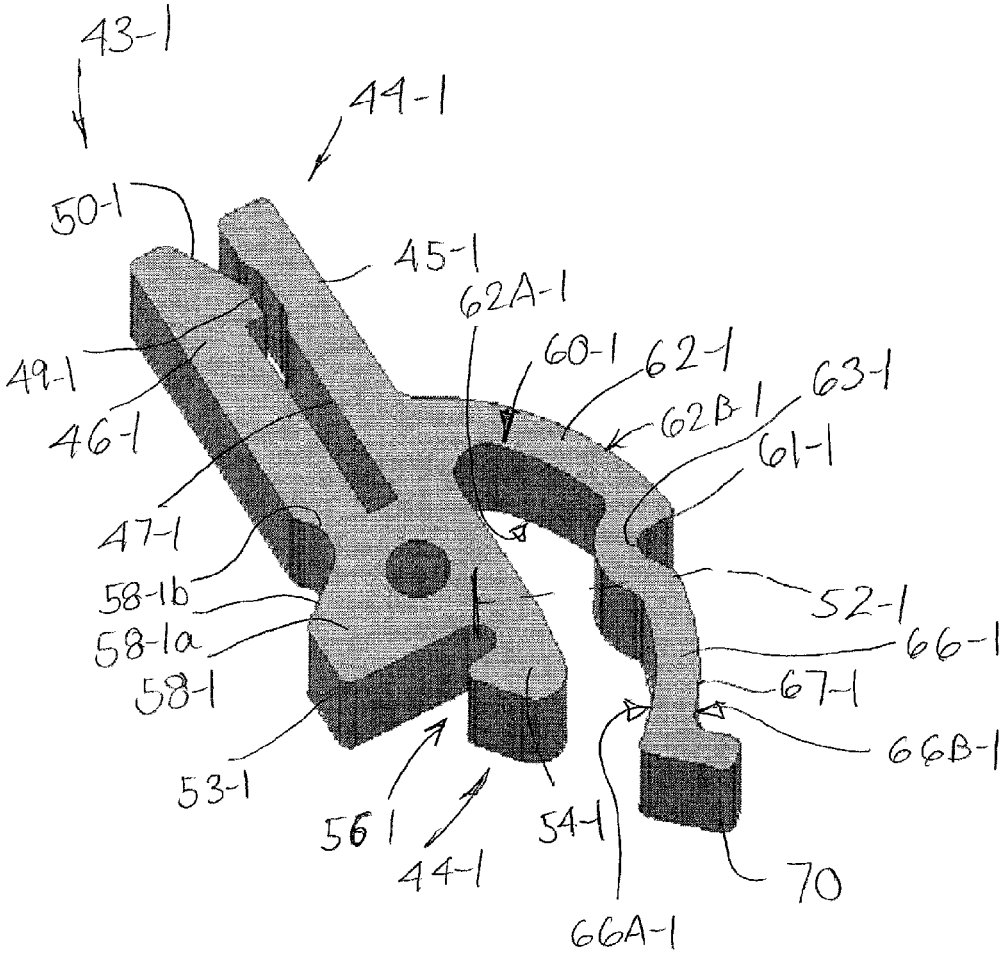
FIG. 8 is a perspective view of a second embodiment of the hinge clip of the present invention.

Referring to FIG. 8, a second improved embodiment of the hinge clips 43 is designated as 43-1. Each hinge clip 43-1 has a structure and function which is essentially the same as that described above with the following discussion primarily focusing on the improvements to the hinge clips 43. Each improved hinge clip 43-1 has a mounting portion 44-1 which is comprised of a fixed jaw 45-1 and a deflectable jaw 46-1. The jaws 4-15 and 46-1 are spaced apart and define a mounting slot 47-1 therebetween. The slot 47-1 has a width like width 48 above that is sized to tight-fittingly receive the bottom panel edge 42 therein in the same manner as described above relative to FIG. 7.

The deflectable jaw 46-1 includes a projection 49-1 adjacent a cam surface 50-1 which spreads the jaws 45-1 and 46-1 as the bottom panel edge 42 is slid into the slot 47-1. Once the projection 49-1 passes over the panel slot 35A, the projection 49-1 drops into the panel slot 35A and snap locks the hinge clip 43-1 to the panel unit 35.

The display unit 12 is now in the form of an assembly of the panel unit 35 and the hinge clips 43-1 similar to the first embodiment assembly seen in FIG. 4. Next, each hinge clip 43-1 includes an engagement portion 51-1 at an end opposite to the mounting portion 44-1. The engagement portion 51-1 engages with a wire frame section forming the wire shelving and preferably connects to a lateral wire section 20 (FIG. 7) so as to hingedly mount the display unit 12 to the wire shelving 10. The hinge clip 43-1 defines a hinge or pivot axis 52-1 like axis 52 about which the display unit 12 rotates between the first and second positions of FIGS. 2 and 3. While the pivot axis 52-1 is preferably oriented horizontally and parallel to the front shelf edge 30, it is possible to mount the hinge clips 43 to a side wall 16 to define a vertical pivot axis, although this orientation is not preferred.

The engagement portion 51-1 preferably comprises a hook like projection 54-1 which define a slot 56-1 which opens sidewardly to rotatably receive the wire section 20 which is slid into the slot 56-1 to the seated position wherein the wire section 20 defines the axis 52-1. In this seated position, the hinge clip 43-1 rotates about the wire section 20 and axis 52-1 defined thereby.

The outside, forward-facing surface 53-1 is defined by a projecting bullnose or nose 58-1, which is block shaped but includes an inclined surface 58-*la* that terminates at an arcuate seat 58-1*b*. This bullnose 58-1 fits into the mesh space 22 between two wire sections 20 like the mesh space 22 seen in FIG. 7 and occupies sufficient space therein so as to prevent the hinge clip 43-1 from separating from the wire section 20 seated in slot 56-1. Also, the arcuate seat 58-1*b* generally receives the forward wire section 20 when the clip assembly is forwardly tilted so as to prevent the clip 43-1 from being pulled from engagement with the rearward wire section 20. With this structure, the hinge clips 43-1 and associated divider unit 12 are rotatably fitted onto the wire section 20.

Referring further to FIG. 8, the hinge clip 43-1 also includes a cantilevered locking member 60-1, which is resiliently deflectable and includes a locking portion or locking formation 61-1 that engages a lateral wire section 20 adjacent to the above-described wire section 20 that is fitted in the slot 56-1. This locking member 60-1 positively maintains the divider unit 12 in the upright position similar to FIGS. 2 and 7 while allowing for free rotative disengagement simply by an individual manually grasping the divider unit 12 and pulling same forwardly to the lowered position like that of FIG. 3.

Preferably, the locking member 60-1 is formed of a first section 62-1 which is dimensioned with a first inside radius 62A-1 and outside radius 62B-1. The first section 62-1 terminates at the locking formation 61-1 which is formed as an arcuate seat and defines an abutment or stop 63-1. This stop 63-1 abuts against the wire section 20 and prevents further rearward rotation of the divider unit 12 past the first position.

The locking member 60-1 also includes a second section 66-1 that defines a terminal end and cam surface 67-1 that faces toward and abuts against the outer surface of the lateral wire section 20 to cause resilient deflection of the locking member 60-1. The second section 66-1 is dimensioned with a second inside radius 66A-1 and outside radius 66B-1 smaller than the first inside radius 62A-1 and outside radius 62B-1. This radial difference allows sliding contact of the cam surface 67-1 with the wire section 20 to deflect the locking member 60-1 as it rotates into the mesh space 22 formed between two adjacent wire sections 20. The larger dimension of the first section 62-1 forms the stop 63-1 which defines the first limit for rotation of the divider unit 12.

The terminal end of the second section 66-1 also defines a second stop 70 that projects radially and is positioned to abut against the respective wire section 20 when the divider unit 12 is in the forwardly tilted position of FIG. 3. Essentially, the stop 70 defines the second limit for rotation of the divider unit 12.

The recessed shape of the locking formation 61-1 seats the wire section 20 therein during panel rotation. As such, the hinge clip 43-1 provides for automatic positive locking of the divider unit 12 in the upright position, and allows for automatic release, simply by pulling the divider panel 12 forwardly. As another advantage, the hinge clip 43-1 allows for easy slidable or interfitting engagement with the wire mesh 20 to permit mounting to a new or original shelving system 10, and also allows for retrofit engagement of the divider unit 12 to any suitable wire frame structures by an installer. This provides an improved inventory system for use in various environments including healthcare environments.

Although particular preferred embodiments of the invention has been disclosed in detail for illustrative purposes, it will be recognized that variations or modifications of the disclosed apparatus, including the rearrangement of parts, lie within the scope of the present invention.

We claim:

1. In an inventory system for a shelving system which comprises a plurality of storage bins defined by shelf walls, comprising the improvement wherein said inventory system includes a pivotable divider unit in each of said bins which subdivides each of said bins into first and second bin sections, said divider unit being pivotable between a first position transverse to a shelf wall and sandwiched between articles removably stored within said bin, and a second position overlying said shelf wall when exposed by removal of selected articles from said bin, wherein said divider unit in said second position is exposed through an open side of said bin to provide an indication that said bin is in need of restocking, said divider unit including at least one hinge clip having an upper slot for receiving a divider panel, an engagement portion that comprises two generally vertical sides that are generally parallel to each other, wherein a lower slot is defined between the two sides of the engagement portion and said lower slot receives said shelf wall so as to hingedly mount said divider unit to said shelf wall and defines a pivot axis about which said divider unit rotates between said first and second positions, said hinge clip including a releasable locking member that is spaced from said engagement portion, wherein the releasable locking member engages said shelf wall to positively maintain said divider unit in said first position while allowing for disengagement by an individual manually pulling said divider unit from said first position to said second position.

2. The inventory system according to claim 1, wherein said locking member is resiliently deflectable and includes a locking portion that engages an adjacent section of said shelf wall.

3. The inventory system according to claim 2, wherein said divider unit is mountable to a wire-type shelving unit wherein said shelf walls are formed of a rigid wire mesh material.

4. The inventory system according to claim 3, wherein said wire mesh is defined by lateral wire sections joined together in a mesh pattern, said hinge clip being hingedly mounted to a first one of said lateral wire sections and said locking member releasably engaging a second one of said lateral wire sections.

5. The inventory system according to claim 4, wherein said locking member is resiliently deflectable and includes a locking portion that engages said second one of said lateral wire sections.

6. The inventory system according to claim 1, wherein said hinge clip is oriented so that said pivot axis is horizontal and said first and second positions correspond to upright and lowered positions.

7. The inventory system according to claim 1, wherein said divider unit mounts to a bottom one of said shelf walls, said bottom wall being formed of a wire mesh comprising a plurality of parallel lateral wire sections, which run parallel to a front edge of said bins and which are rigidly joined together with parallel main wire sections that run in a front to back direction of said bin, said wire mesh defining rectangular open spaces and said hinge clip being mounted to a first one of said wire sections and said locking member releasably engaging a second one of said wire sections.

8. The inventory system according to claim 7, wherein said first and second bin sections are oriented as front and rear bin sections accessed through an open front side of said bin.

9. The inventory system according to claim 1, wherein said divider unit lies adjacent a front edge of a bin opening when in said second position, said divider unit including an indicator which is adjacent to and exposed from said front edge.

10. The inventory system according to claim 9, wherein said hinge clip includes a stop on said locking member which defines said first position.

11. An inventory system for a wire shelving system which comprises a plurality of storage bins defined by shelf walls, said inventory system comprising one or more divider units pivotally mountable within a bin to subdivide each bin into first and second bin sections, wherein said divider unit is pivotable between first and second positions, each of said divider units comprising:

a panel unit having a bottom panel edge and a free edge spaced therefrom, said free edge being exposed when said divider unit is in said second position; and one or more hinge clips removably mounted to said bottom panel edge, each of said hinge clips including an engagement portion which includes two generally vertical sides that are generally parallel to each other, wherein a mounting slot is defined between the two sides of the engagement portion and said mounting slot receives a wire section of a shelf wall, said engagement portion being rotatable about a first wire section to define a pivot axis about which said panel unit rotates between said first and second positions, said hinge clip including a generally arcuate releasable locking member, which engages with a second wire section spaced from said mounting slot to positively maintain said divider unit in said first position while allowing for disengagement from said first position by an individual manually pulling said divider unit from said first position to said second position.

12. The inventory system according to claim 11, wherein said locking member is resiliently deflectable and includes a locking portion that engages the second wire section.

13. The inventory system according to claim 12, wherein said hinge clip includes a stop on said locking member which defines said first position.

14. The inventory system according to claim 11, wherein said panel unit has a plate shape and includes a depending display panel on said free edge portion.

15. The inventory system according to claim 14, wherein said display panel including an indicator which indicates a type of article being stored in a respective said bin.

16. The inventory system according to claim 15, wherein said indicator is oriented to face forwardly and be exposed when in said second position to provide a cue for restocking of articles within a bin.

17. The inventory system according to claim 11, wherein each said hinge clip is removably engaged with said panel unit through a snap locking engagement to provide for tool free mounting of each said hinge clip to said bottom panel edge.

18. The inventory system according to claim 17, wherein said panel unit including a lock formation for each said hinge clip which is formed as a connector slot engaged by a complementary formation on said hinge clip.

19. The inventory system according to claim 11, wherein said engagement portion comprises a pair of resiliently deflectable connector jaws which define said mounting slot and have inclined camming surfaces which spread said jaws when pressed against a wire section which seats therein, wherein inside surfaces of said jaws include arcuate seats which receive and seat on an outside surface of a first wire section, said locking member being resiliently deflectable and including a locking formation that engages a second wire section spaced from a first wire section seated in said slot.

20. The inventory system according to claim 11, wherein said engagement portion comprises a mounting slot that receives a wire section therein.

* * * * *